US005547425A

United States Patent [19]

Krhs et al.

[11] Patent Number: 5,547,425

[45] Date of Patent: Aug. 20, 1996

[54] FUTURE TODER RECREATIONAL DEVICE

[76] Inventors: Gre Krhs, 1182B Market St. #643, San Francisco, Calif. 94102; George Spector, 233 Broadway Rm. 702, New York, N.Y. 10279

[21] Appl. No.: 303,728

[22] Filed: Sep. 9, 1994

[51] Int. Cl.[6] ..... A63G 1/32

[52] U.S. Cl. ..... 472/110; 482/93

[58] Field of Search ..... 472/106, 108, 472/110, 112, 113, 4; 482/92–94

[56] References Cited

U.S. PATENT DOCUMENTS

| | | | |
|---|---|---|---|
| 1,832,755 | 11/1931 | Waddell | 472/110 |
| 2,544,106 | 3/1951 | Ray | 472/110 |
| 2,704,111 | 3/1955 | Wunderlich | 472/110 X |
| 2,726,085 | 12/1955 | Brand | 472/4 |
| 2,873,118 | 2/1959 | Dimitriasis | 472/110 |
| 3,514,103 | 5/1970 | Lieberman | 472/110 |
| 4,319,746 | 3/1982 | Chang | 472/4 |
| 5,139,472 | 8/1992 | Caruthars | 482/93 |

*Primary Examiner*—Carl D. Friedman
*Assistant Examiner*—Beth A. Aubrey

[57] ABSTRACT

A playground apparatus is provided which consists of a base having a central ring bearing mounted onto the ground. A stanchion extends upwardly form the central ring bearing in the base, so as to rotate thereabout. An elongate balance beam is pivotally mounted near the top of the stanchion for movement up and down. A seat assembly is located at a first end of the balance beam to receive a person. A structure is located at a second end of the balance beam, for counterbalancing the weight of the person in the seat assembly. This permits the person to rotate the stanchion through a complete revolution in a clockwise and counterclockwise direction and to move the balance beam up and down.

4 Claims, 1 Drawing Sheet

FUTURE TODER RECREATIONAL DEVICE

BACKGROUND OF THE INVENTION

The instant invention relates generally to recreational devices and more specifically it relates to a playground apparatus which provides an adjustable counterbalanced weight that can be maneuvered by a single individual, whereby it will rotate as well as move up and down.

There are available various conventional recreational devices which do not provide the novel improvements of the invention herein disclosed.

SUMMARY OF THE INVENTION

A primary object of the present invention is to provide a playground apparatus that will overcome the shortcomings of the prior art devices.

Another object is to provide a playground apparatus that operates similarly to a teeter-totter, except that an adjustable counterbalanced weight is utilized, in which the need to have a second person of a similar size ride on an opposite end is eliminated.

An additional object is to provide a playground apparatus that offers greater safety than conventional teeter-totters, offer hours of exciting diversions and affords an alternative to swing sets and other ordinary recreational devices.

A further object is to provide a playground apparatus that is simple and easy to use.

A still further object is to provide a playground apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention, wherein a seat assembly provided for the user is mounted onto a balanced beam on a stanchion, which can be rotated by the user and including a counterbalancing adjustable weight assembly, while there is also provided a support pole for locking the balance beam and the stanchion in a fixed position.

DETAILED DESCRIPTION OF THE PREFERRED EMBODIMENTS

Figure 1:
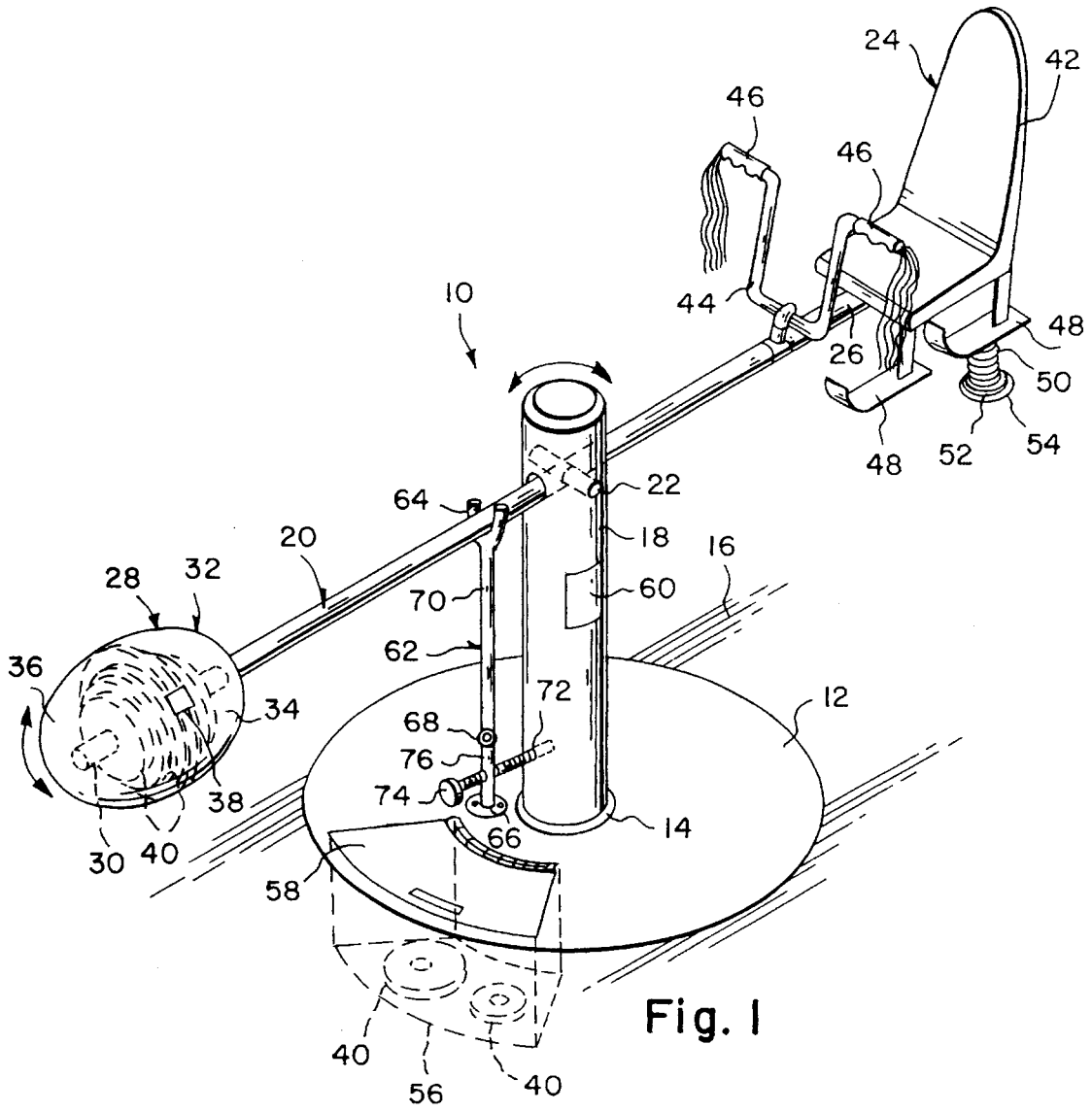

Turning now descriptively to the drawings, in which similar reference characters denote similar elements throughout the several views, FIG. 1 illustrates a playground apparatus 10, which consists of a base 12 having a central ring bearing 14 mounted onto the ground 16. A stanchion 18 extends upwardly from the central ring bearing 14 in the base 12, so as to rotate thereabout. An elongate balance beam 20 is pivotally mounted at 22 near the top of the stanchion 18, for movement up and down. A seat assembly 24 is located at a first end 26 of the balance beam 20, to receive a person. A structure 28 is located at a second end 30 of the balance beam 20, for counterbalancing the weight of the person in the seat assembly 24. This permits the person to rotate the stanchion 18 through a complete revolution in a clockwise and counterclockwise direction and to move the balance beam 20 up and down.

The counterbalancing structure 28 includes an egg-shaped housing 32, having a first portion 34 connected to the second end 30 of the balance beam 20. A second portion 36 of the housing 32 is separable from the first portion 34. A swing clasp 38 is on the housing 32 for retaining the second portion 36 to the first portion 34. A plurality of adjustable various sized barbell type weights 40 are provided. They can be placed in any combination onto the second end 30 of the balance beam 20 within the housing 32, to match the weight at the first end 26 of the balance beam 20.

The seat assembly 24 contains a contour seat 42 mounted to the first end 26 of the balance beam 20. A handlebar 44 with a pair of hand grips 46 is fixed to the balance beam 20 in front of the contour seat 42. A plurality of footrests 48 are provided, with each extending from the underside of the contour seat 42. A coil spring 50 extends downwardly from the rearmost footrest 48. A steel plate 5 is secured to a lower distal end of the spring 50. A replaceable rubber pad 54 is on the steel plate 52, to make contact with the ground 16. The coil spring 50 with the steel plate 52 and the rubber pad 54 will act as a shock absorber.

The base 12 has an underground compartment 56 for storing the weights 40 therein. A hinged lid 58 is on the base 12 for covering the compartment 56. The stanchion 18 has a side chamber 60 for storing beverages therein.

A stationary support pole 62 is utilized, having a U-shaped forked upper end 64. The support pole 62 is secured at its lower end 66 to the base 12, to extend upwardly in a generally parallel relationship next to the stanchion 18. The U-shaped forked upper end 64 can engage with the balance beam 20, to prevent the balance beam 20 from moving up and down. A hinge 68 is in the support pole 62, to allow an upper segment 70 of the support pole 62 to pivot downwardly, to release the balance beam 20, so that the balance beam 20 can move up and down. The stanchion 18 has a transverse threaded bore 72 near its lower end. A set screw 74 is transversely threaded through a lower segment 76 of the support pole 62, so that the seat screw 74 can engage with the transverse threaded bore 72, to prevent rotation of the stanchion 18.

OPERATION OF THE INVENTION

To use the playground apparatus 10, simply open the housing 32 and place the proper amount of weights 40 on the second end 30 of the balance beam 20, to match the weight at the first end 26. Make sure that the upper segment 70 of the support pole 62 is pivoted downwardly and the set screw 74 is disengaged from the transverse threaded bore 72. The balance beam 20 can now move up and down, while the stanchion 18 can rotate.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A playground apparatus which comprises:

a) a base having a central ring bearing mounted onto the ground;

b) a stanchion extending upwardly from said central ring bearing in said base, so as to rotate thereabout;

c) an elongate balance beam pivotally mounted near the top of said stanchion for movement up and down;

d) a seat assembly located at a first end of said balance beam to receive a person;

e) means located at a second end of said balance beam for counterbalancing the weight of the person in said seat, so as to permit the person to rotate said stanchion through a complete revolution in a clockwise and counterclockwise direction and to move said balance beam up and down; wherein said counterbalancing means includes:

f) an egg-shaped housing having a first portion connected to the second end of said balance beam, whereby a second portion of said housing is separable from the first portion;

g) a swing clasp on said housing for retaining the second portion to the first portion and h) a plurality of adjustable various sized barbell type weights, which can be placed in any combination onto the second end of said balance beam within said housing, to match the weight at the first end of said balance beam.

2. A playground apparatus as recited in claim 1, wherein said seat assembly includes:

a) a contour seat mounted to the first end of said balance beam;

b) a handlebar with a pair of hand grips fixed to said balance beam in front of said contour seat;

c) a plurality of footrests extending from the underside of said contour seat;

d) a coil spring extending downwardly from said rearmost footrest;

e) a steel plate secured to a lower distal end of said spring and f) a replaceable rubber pad on said steel plate to make contact with the ground, so that said coil spring with said steel plate and said rubber pad will act as a shock absorber.

3. A playground apparatus as recited in claim 1, further including:

a) said base having an underground compartment for storing said weights therein;

b) a hinged lid on said base for covering said compartment and c) said stanchion having a side chamber for storing beverages therein.

4. A playground apparatus as recited in claim 2, further including:

a) a stationary support pole having a U-shaped forked upper end, said support pole secured at its lower end to said base to extend upwardly in a generally parallel relationship next to said stanchion, so that said U-shaped forked upper end can engage with said balance beam to prevent said balance beam from moving up and down;

b) a hinge in said support pole to allow an upper segment of said support pole to pivot downwardly to release said balance beam, so that said balance beam can move up and down;

c) said stanchion having a transverse threaded bore near its lower end and d) a set screw transversely threaded through a lower segment of said support pole, so that said set screw can engage with said transverse threaded bore, to prevent rotation of said stanchion.

* * * * *